US007240868B2

(12) United States Patent
Lin et al.

(10) Patent No.: US 7,240,868 B2
(45) **Date of Patent: *Jul. 10, 2007**

(54) DYNAMIC RING CLASSIFIER FOR A COAL PULVERIZER

(75) Inventors: Qingsheng Lin, Holden, MA (US); Craig A. Penterson, Sutton, MA (US); Daniel P. Smith, Spencer, MA (US); Richard N. Du Verger, Danielson, CT (US)

(73) Assignee: Riley Power, Inc., Worcester, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/405,232

(22) Filed: Apr. 17, 2006

(65) Prior Publication Data

US 2006/0180685 A1 Aug. 17, 2006

Related U.S. Application Data

(63) Continuation of application No. 10/699,982, filed on Nov. 3, 2003, now Pat. No. 7,028,931.

(51) Int. Cl.
*B02C 23/10* (2006.01)

(52) U.S. Cl. ..... 241/79.1; 209/134; 209/713; 241/188.1

(58) Field of Classification Search ..... 241/79.1, 241/188.1; 209/134, 713
See application file for complete search history.

(56) References Cited

U.S. PATENT DOCUMENTS

| | | | | |
|---|---|---|---|---|
| 1,628,609 | A | 5/1927 | Newhouse | |
| 2,625,332 | A * | 1/1953 | Rogers et al. | 241/300 |
| 2,628,038 | A | 2/1953 | Rogers et al. | |
| 2,639,863 | A | 5/1953 | Rogers | |
| 3,050,018 | A | 8/1962 | Pearson | |
| 3,092,337 | A | 6/1963 | Patterson | |
| 4,424,938 | A | 1/1984 | Day | |
| 4,485,975 | A | 12/1984 | Eigner | |
| 4,919,795 | A * | 4/1990 | Fujii et al. | 209/135 |
| 5,025,930 | A * | 6/1991 | Barthelmess | 209/714 |
| 5,289,978 | A * | 3/1994 | Lundquist | 241/57 |
| 5,348,272 | A * | 9/1994 | Lukstas et al. | 251/214 |
| 5,560,550 | A | 10/1996 | Krawczyk | |
| 5,938,045 | A * | 8/1999 | Makino et al. | 209/713 |
| 6,027,057 | A | 2/2000 | Miles | |
| 6,443,376 | B1 * | 9/2002 | Huang et al. | 241/52 |
| 6,644,479 | B1 * | 11/2003 | Kimmeyer et al. | 209/154 |
| 2003/0141396 | A1 | 7/2003 | Whaley | |

OTHER PUBLICATIONS

L.M. Benson, C.A. Penterson, A Comparison of Three Types of Coal Pulverizers, Presented to American Power Conference, Chicago, Illinois, Apr. 22-24, 1985, (8 pages, Riley Stoker Corporation, Worcester, Mass.).

* cited by examiner

*Primary Examiner*—Mark Rosenbaum
(74) *Attorney, Agent, or Firm*—Edwards Angell Palmer & Dodge LLP

(57) ABSTRACT

The present invention is directed to, among other things, a classifier assembly for mounting on the center shaft of a rotary coal pulverizer which includes a labyrinthian sealing arrangement operatively associated with the shaft for limiting the egress of unacceptably large coal particles from the pulverizer.

17 Claims, 6 Drawing Sheets

DYNAMIC RING CLASSIFIER FOR A COAL PULVERIZER

CROSS-REFERENCE TO RELATED APPLICATIONS

This application is a continuation of prior application Ser. No. 10/699,982 filed Nov. 3, 2003, now issued as U.S. Patent No. 7,028,931 granted on Apr. 18, 2006, the entirety of which is incorporated by reference herein.

BACKGROUND OF THE INVENTION

1. Field of the Invention

The present invention relates to a system and assembly for limiting the egress of particles from a material size reduction process based on the particle size, and more particularly, it concerns an improved classifier assembly for a rotary coal pulverizer.

2. Background of the Related Art

In operations that use coal for fuel, finely-ground coal particles or "fines" are required for efficient operation. The pulverized firing of lower-cost lower-grade coal, coke, or lignite yields higher combustion efficiency than stoker firing, as well as rapid response to load changes. Thus, it is common practice to supply raw coal to a device that will reduce the size of the coal to particles within a desirable range, such as a pulverizer, prior to being used for combustion.

Many pulverizers employ systems and methods including one or more crushing and grinding stages for breaking up the raw coal. It is important to maintain close control over the size of the pulverized coal used for combustion because finely pulverized coal produces less nitrous oxide ($NO_X$) emissions and keeps oversized loss-on-ignition (LOI) unburned coal particles from contaminating the marketable ash byproduct of the combustion chamber, among other things. Coal particles leaving the device have to be reduced to dust fine enough to become airborne by repeated crushing actions of the rolling or flailing elements of the device. Air is swept through the device and the dust particles are entrained in an air stream and carried out for combustion.

There is a need for the classification of the solid coal particles on the basis of particle size so that only acceptably sized fines exit the pulverizer, while the egress of unacceptably sized particles is limited, and the particles remain for further size reduction. Some pulverizers require an add-on device, such as an external classifier, to separate and recycle unacceptably large sized particles back to the pulverizer. Other coal pulverizers, such as rotary coal pulverizers, include internal rejector assemblies that operate along with the pulverizer to block unacceptably large sized particles so that these particles stay within the pulverizer for further size reduction, while allowing acceptably sized particles to move through the rejectors. In these rejector assemblies, it is often difficult to install and maintain the rejector arm gap at the desired size. Furthermore, wear and tear on the assembly can further increase the difficulty of maintaining a consistent rejector arm gap.

However, no prior art coal pulverizer includes an internal system that is as uniquely effective at limiting the egress of unacceptably sized particles as the present invention disclosed herein below. Rotary coal pulverizers in particular can advantageously provide an exceptionally fast processing time, less transport time to the burners, and an easily controllable input/output flow relationship, among other benefits.

SUMMARY OF THE DISCLOSURE

The present invention improves upon and solves the problems associated with the prior art by providing, among other things, a classifier assembly for mounting on a center shaft of a material size reducing system, wherein the center shaft defines an axis of rotation and is configured for rotational motion within a process chamber of the material size reducing system.

In particular, the classifier assembly includes an elongate arm configured for mounting on the center shaft in such a manner as to extend radially outward from the center shaft, and a labyrinthian sealing arrangement operatively associated with a radially outer portion of the arm for limiting the egress of particles from the process chamber based on particle size as the center shaft is rotated. The classifier assembly can include a plurality of elongate arms and a flange for mounting the plurality of elongate arms to the center shaft.

In one embodiment, the labyrinthian sealing arrangement includes an annular rotator including an axially projecting, radially inner ring and a plurality of axially projecting members, such as baffles or beaters, along a radially outer circumference of the rotator. Preferably, the projecting members are substantially evenly spaced from one another. Alternatively, the radially outer circumference may include a radially outer ring. The labyrinth seal also includes an annular stator which has an axially projecting portion defining a radially inner surface and opposing radially outer surface.

The stator is configured and dimensioned for mounting in the process chamber in such a manner as to be positioned axially adjacent to the rotator, so that the radially inner surface of the axially projecting portion is in a radially adjacent relationship with respect to the radially inner ring of the rotator and the radially outer surface of the axially projecting portion is in a radially adjacent relationship with respect to the plurality of axially projecting members along the radially outer circumference of the rotator.

The present invention is also directed to a system for limiting particle egress in a material size reduction device having a chamber with a center shaft mounted for rotational motion therein. The system includes an elongate arm configured for mounting on the center shaft in such a manner as to extend radially outward from the center shaft, and a labyrinthian sealing arrangement operatively associated with a radially outer portion of the arm and configured for limiting the egress of particles from the chamber based on particle size during rotational motion of the center shaft. The system can include a plurality of elongate arms and a flange for mounting the plurality of elongate arms to the center shaft. The labyrinthian sealing arrangement can be of the same embodiment as the one discussed above.

The present invention is also directed to a coal pulverizer that includes a grinding chamber and a center shaft that defines an axis of rotation and is configured for rotational motion within the grinding chamber. The coal pulverizer includes a classifier assembly in accordance with the present invention that has an elongate arm mounted on the center shaft in such a manner as to extend radially outward from the center shaft and a labyrinthian sealing arrangement operatively associated with a radially outer portion of the elongate arm and configured for limiting the egress of coal particles from the grinding chamber based on particle size during rotational motion of the center shaft.

As discussed above, the labyrinthian sealing arrangement can include an annular rotator having an axially projecting inner ring and a plurality of axially projecting members, such as baffles or beaters, along a radially outer circumference of the rotator. Preferably, the projecting members are substantially evenly spaced from one another. Alternatively, the radially outer circumference may include an outer ring. The labyrinth seal also includes an annular stator which has an axially projecting portion defining a radially inner surface and opposing radially outer surface. This stator is configured and dimensioned for mounting in the process chamber in such a manner as to be positioned axially adjacent to the rotator, so that the radially inner surface of the axially projecting portion is in an adjacent relationship with respect to the inner ring of the rotator and the outer surface of the axially projecting portion is in an adjacent relationship with respect to the plurality of axially projecting members along the outer circumference of the rotator.

In this pulverizer, crushed coal is supplied to the grinding chamber from a crusher chamber including a swing hammer assembly operatively associated with the center shaft. The grinding chamber further includes a plurality of stationary pegs and an assembly having a plurality of grinding clips operatively associated with the center shaft. The coal particles from the grinding chamber are received in a fan chamber which has a fan assembly operatively associated with the center shaft and configured for transporting coal particles entrained with air. Preferably, the labyrinthian sealing arrangement limits the egress of unacceptably large sized coal particles from the grinding chamber to the fan chamber.

These and other aspects of the present invention will become more readily apparent to those having ordinary skill in the art from the following detailed description of the invention taken in conjunction with the drawings.

BRIEF DESCRIPTION OF THE FIGURES

So that those having ordinary skill in the art to which the present invention pertains will more readily understand how to make and use the present invention, an embodiment thereof will be described in detail with reference to the drawings, wherein.

DETAILED DESCRIPTION OF THE PREFERRED EMBODIMENTS

Reference is now made to the figures and accompanying detailed description which have been provided to illustrate exemplary embodiments of the present invention, but are not intended to limit the scope of embodiments of the present invention. Although a particular type of rotary coal pulverizer is shown in the figures and discussed herein, it should be readily apparent that a device or system constructed in accordance with the present invention can be employed in a variety of other coal pulverizers, or other applications that do not involve coal as the raw material. In other words, the specific material and size reduction process is not vital to gaining the benefits associated with using a system constructed in accordance with the present invention.

Figure 1:
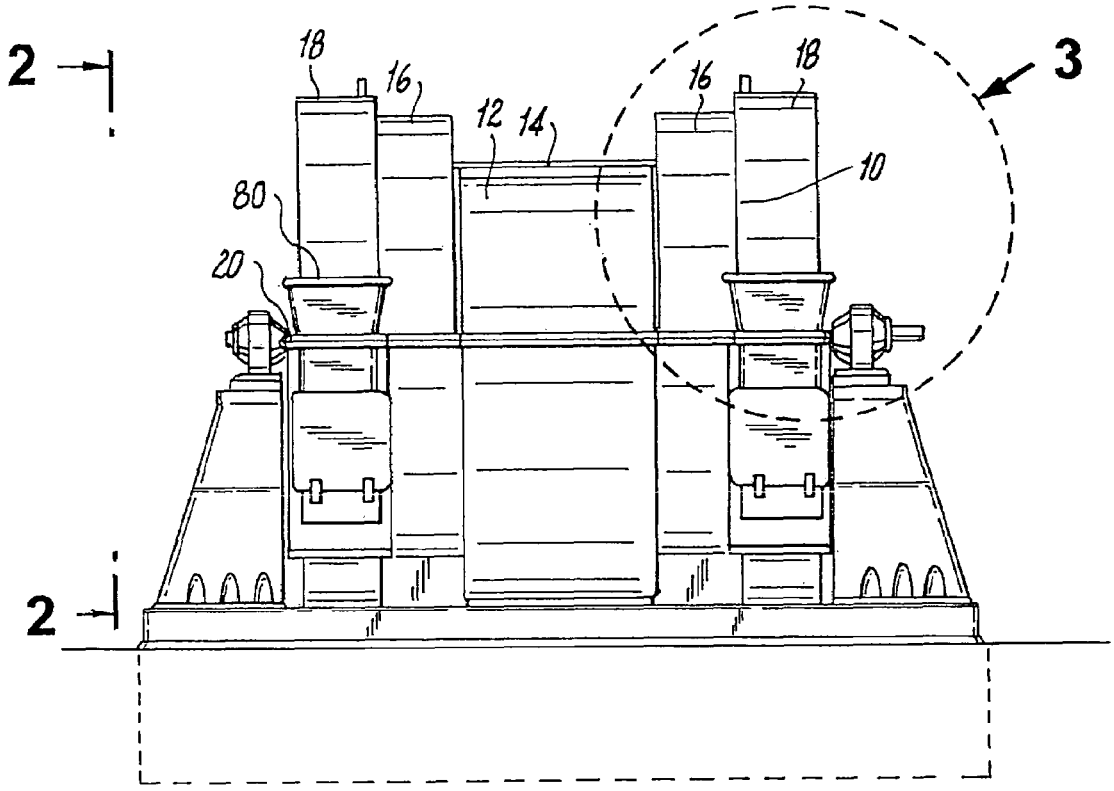
FIG. 1 is front view of an exemplary rotary coal pulverizer (duplex model) which can employ a classifier assembly constructed in accordance with the present invention therein mounted on the center shaft at two locations.
Figure 2:
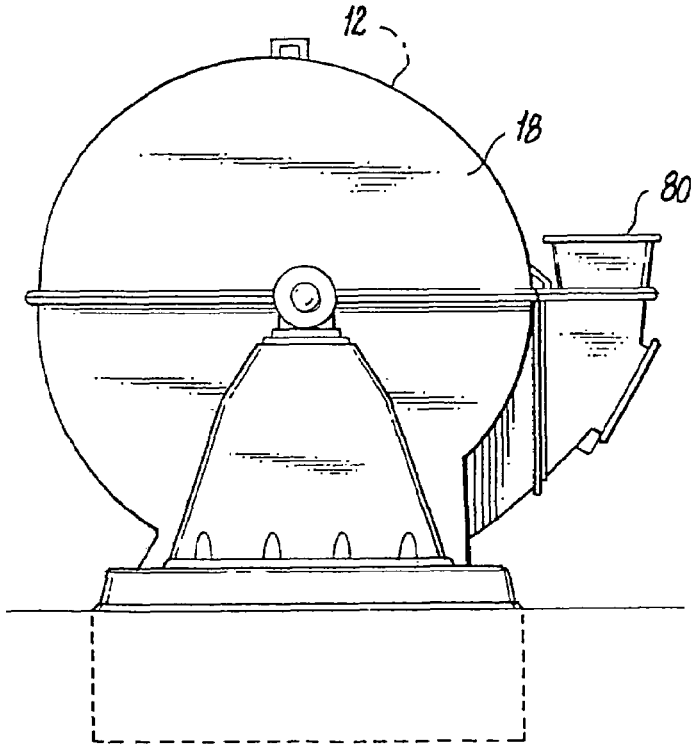
FIG. 2 is a side view of the rotary coal pulverizer of FIG. 1, illustrating the output from the fan section of the pulverizer.

FIGS. 1 and 2 illustrate the general location of a presently preferred embodiment of a classifier assembly 10, constructed in accordance with the present invention and employed in an exemplary rotary coal pulverizer 12, from the exterior of pulverizer 12. Pulverizer 12 is known as a horizontal type high speed coal mill and is closely based on a duplex model ATRITA® Pulverizer sold commercially by Babcock Power Inc. However, this should not be interpreted as limiting the present invention in any way, as these types of pulverizers incorporate the same basic elements of importance that render it suitable for the proper utilization of present invention.

The duplex models are essentially two single models side by side with a double sized integrally connected middle section. Classifier assembly 10 may also be disposed in a single model, or in a duplex model with one at each end. For purposes of ease and convenience in describing the features of the present invention, only a single side of the duplex model is discussed herein.

Pulverizer 12 consists essentially of a crusher-dryer section 14, a grinding section 16 and a fan section 18. A center shaft 20 extends through the pulverizer 12 and defines an axis of rotation. Thus, terms used herein, such as "radially outer" and "radially inner," therefore refer to the relative distance in a perpendicular direction from the axis defined by center shaft 20, while "axially inner" and "axially outer" refer to the distance along or parallel to the axis defined by center shaft 20, wherein the "axially innermost" section in pulverizer 12 is crusher-dryer section 14.

Raw coal and primary air enter the crusher-dryer section 14. Swing hammers 22 mounted on and driven by center shaft 20, along with impact liners (not shown), operate to crush the coal against a grid (not shown). High temperature primary air is used to flash dry any surface moisture on the coal, which helps minimize the effect of moisture on coal capacity, coal fineness, and power consumption, among other things. As the high-temperature primary air evaporates moisture from the coal, the temperature of the coal-air mixture is reduced, which significantly reduces the risk of fires within the pulverizer.

When coal passes through the grid of the crusher-dryer section 14, it enters the axially outer adjacent grinding section 16. Major grinding components in grinding section 16 include stationary pegs 24 and moving clips 26 disposed on a wheel 28. Wheel 28 is mounted on and driven by center shaft 20, preferably at a relatively high rate of speed. The turbulent flow and impact momentum on particles, caused by the movement of clips 26 and stationary pegs 24, create a particle to particle attrition which further reduces the size of the coal particles received from crusher-dryer section 14. Classifier assembly 10 is positioned on the axially outer portion of grinding section 16, in the interface between grinding section 16 and fan section 18 to separate grinding section 16 from fan section 18.

Figure 3:
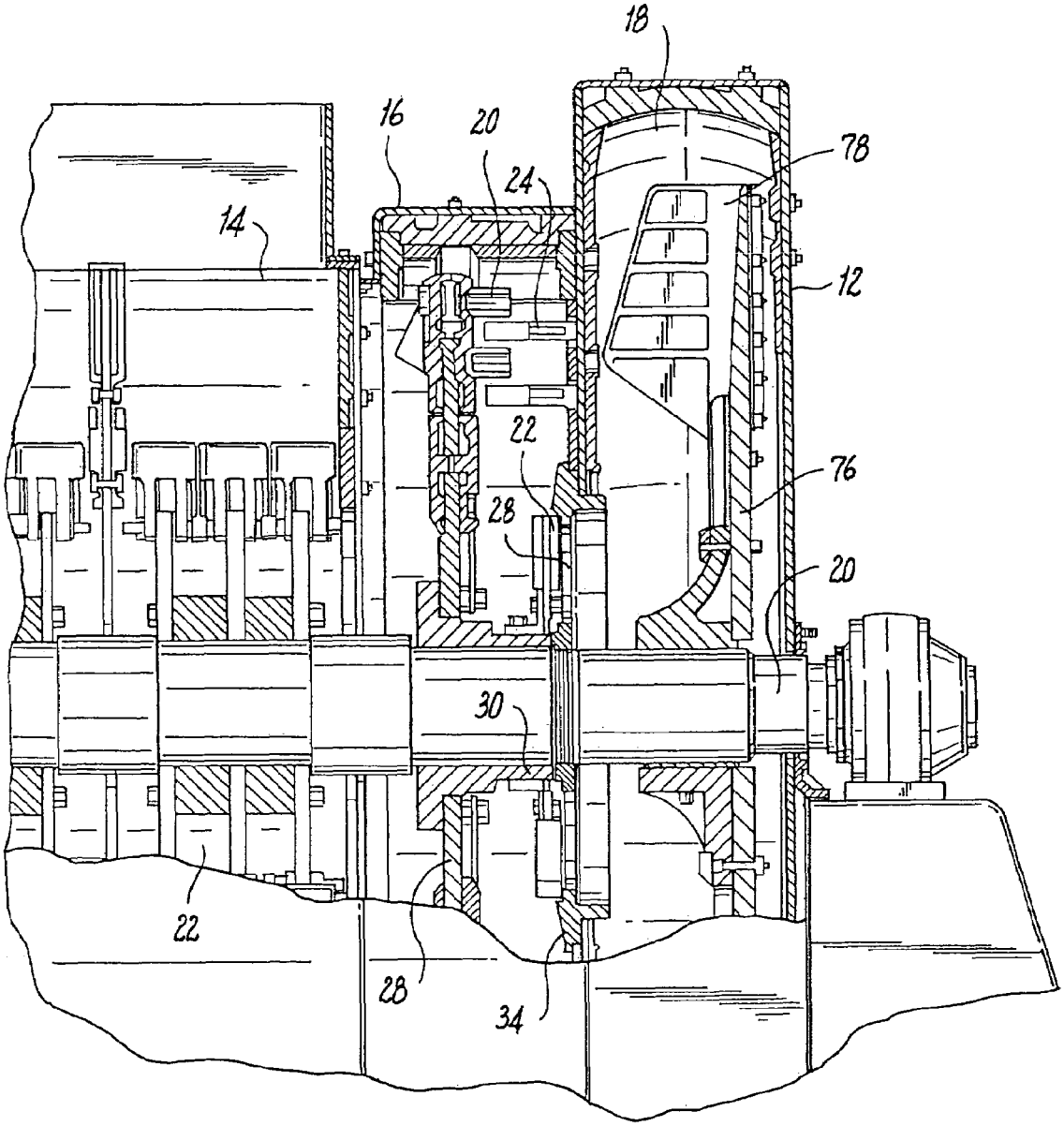
Fig. 3 (Prior Art)
FIG. 3 is an enlarged localized partial cross-sectional view of a portion of the exemplary rotary coal pulverizer of FIG. 1, illustrating a prior art classifier assembly positioned in the interface between the grinding section and the fan section.
Figure 4:
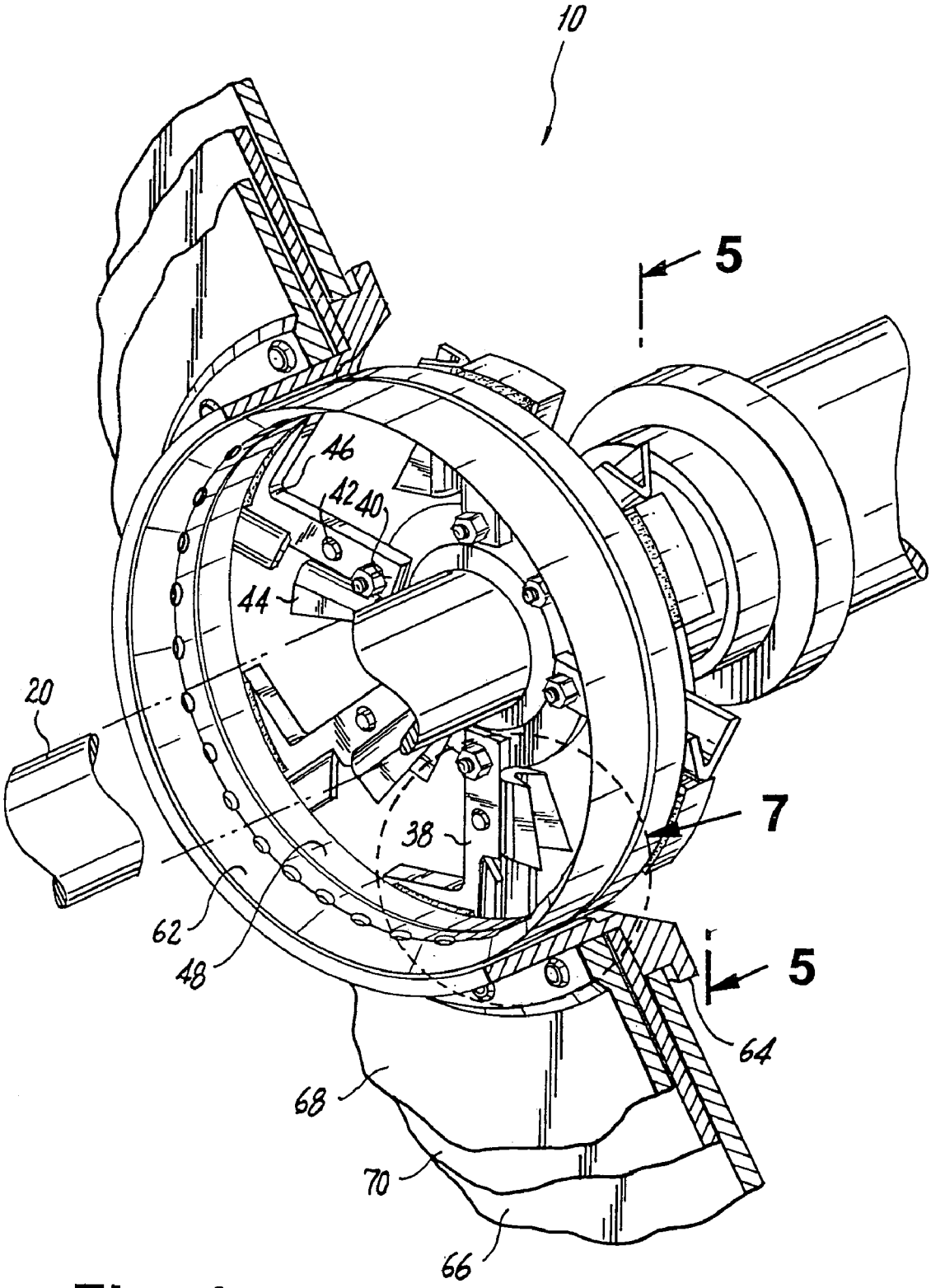
FIG. 4 is a perspective partial cross-sectional view of a classifier assembly constructed in accordance with the present invention, illustrating the stator in cross section and the rotator forming the labyrinthian seal.
Figure 5:
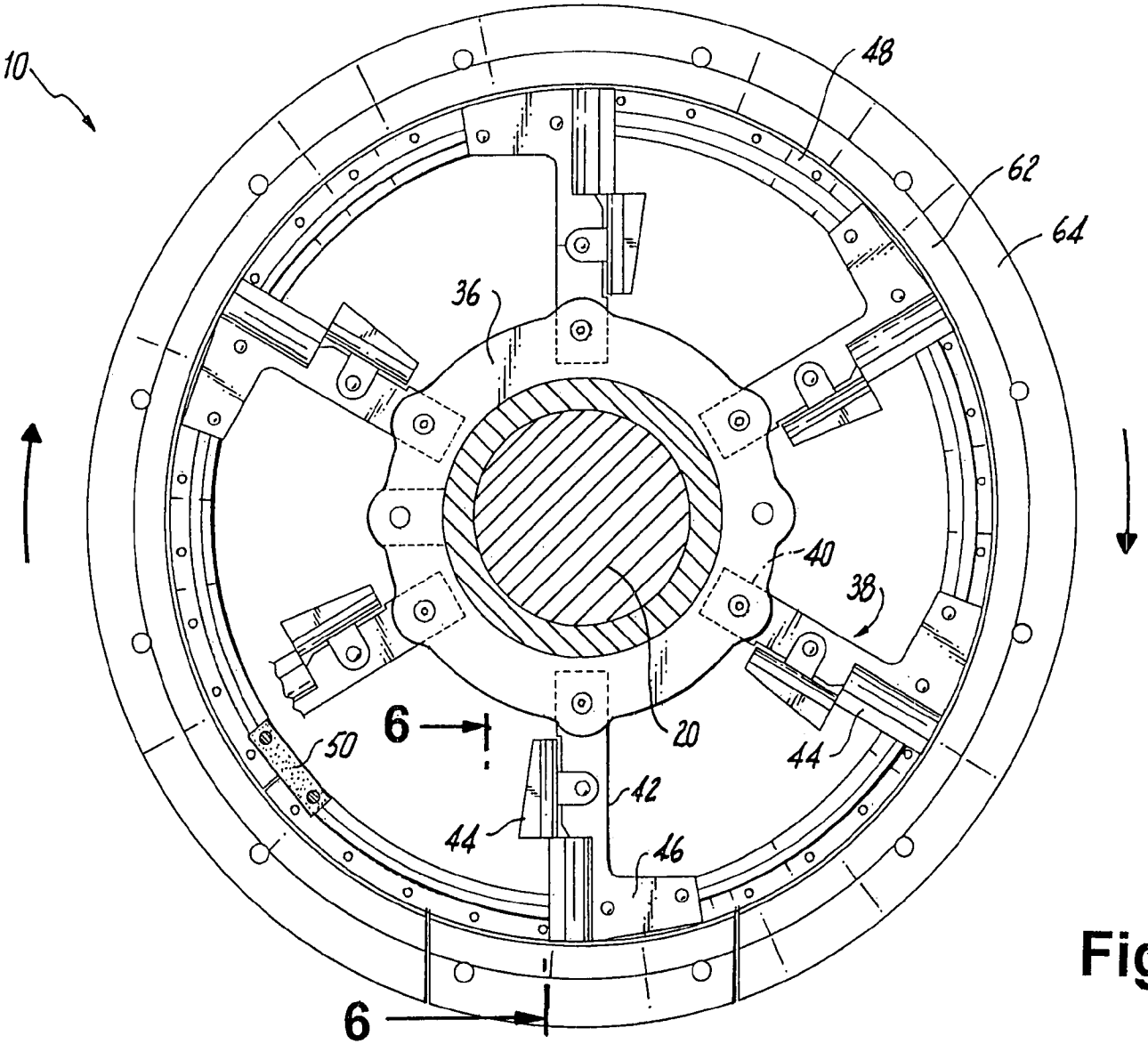
FIG. 5 is a cross sectional view of the classifier assembly of FIG. 4, taken along line 5—5 of FIG. 4, illustrating the adjustable flange mounted on the center shaft, radially outward extending elongate arms, rotator and stator.
Figure 6:
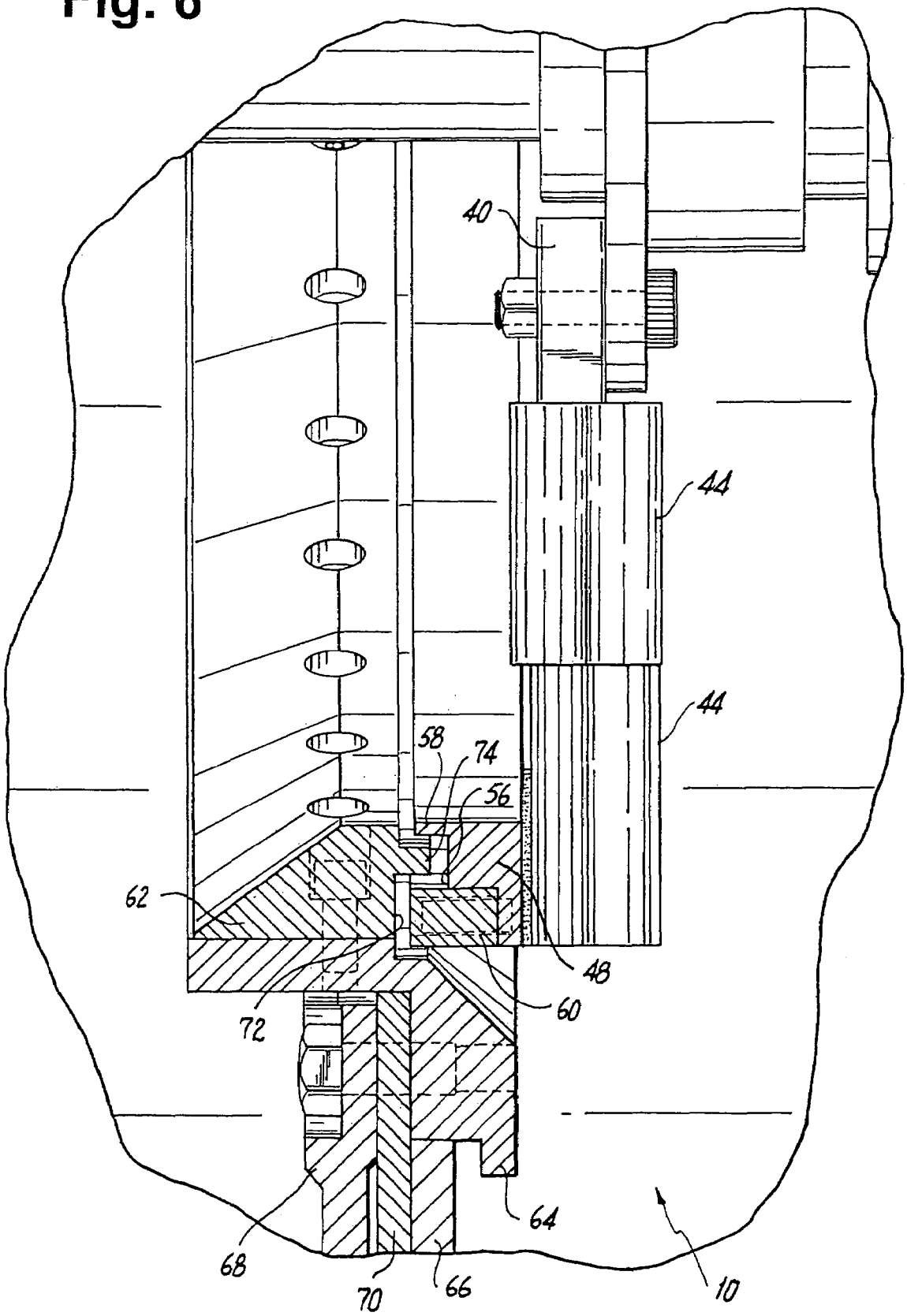
FIG. 6 is a localized cross sectional view of the classifier assembly of FIG. 4, taken along line 6—6 of FIG. 5, illustrating the labyrinth seal formed by the stator and rotator.
Figure 7:
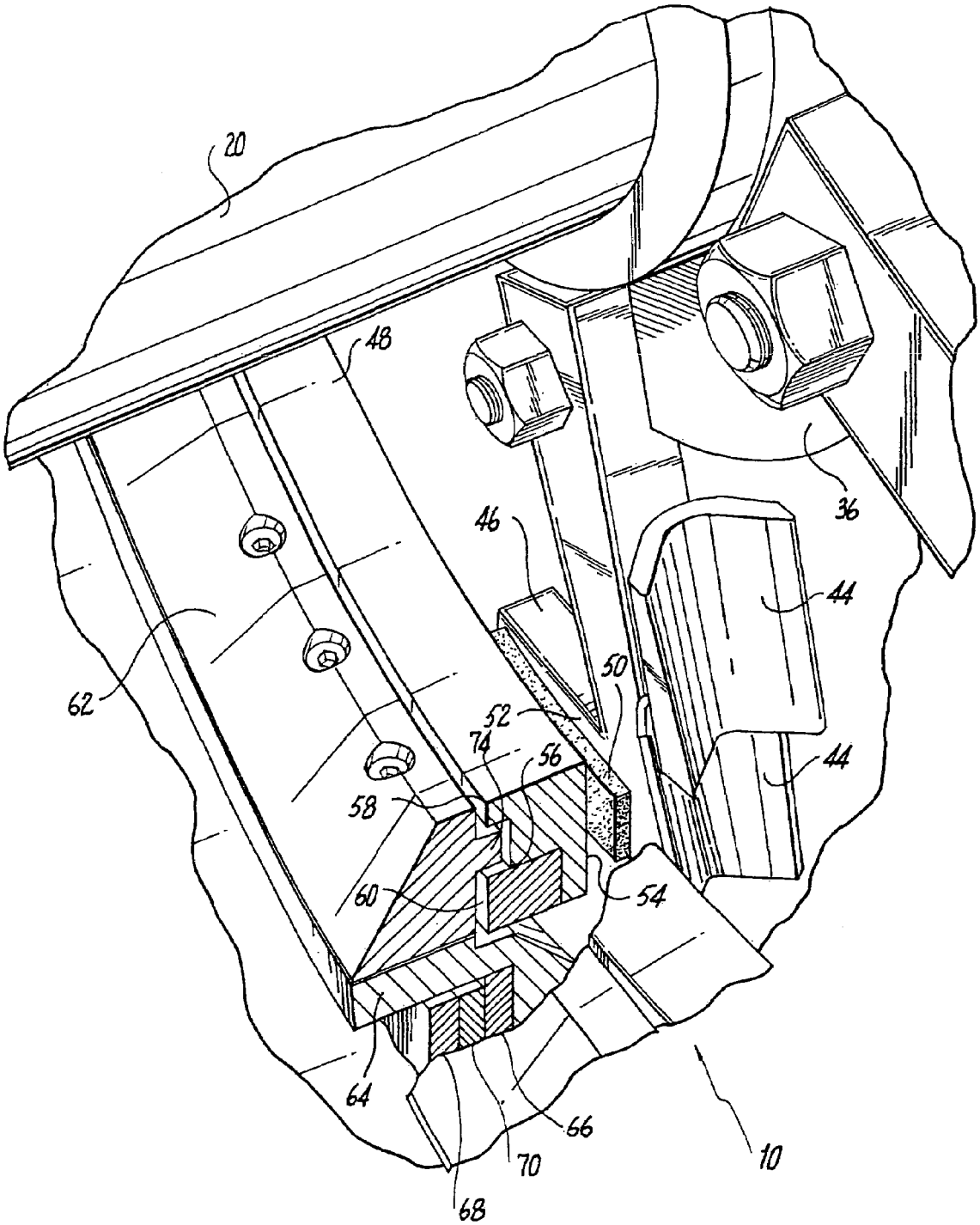
FIG. 7 is an enlarged localized perspective view of the classifier assembly of FIG. 4, illustrating the stator and rotator in cross section.

A prior art rejector assembly generally designated by the reference numeral 28 is illustrated in FIG. 3 to compare with the classifier assembly 10 constructed in accordance with the present invention, which is discussed in further detail immediately below. Prior art rejector assembly 28 is basically composed of an axially adjustable hub 30, several V-shaped rejector arms 32 extending radially outward from hub 30, and a stationary rejector ring 34. In the prior art design, it is essential to set a relatively small clearance for particle egress between the axially inner surface of the rejector ring 34 and radially outer end of the rejector arms 32 to achieve acceptable coal fineness. However, this requirement for minimal clearance is difficult to maintain due to material wear, among other things. The wear to the parts alters the clearance allowing for egress of unacceptably large particles resulting in the inability to control coal fineness in the pulverizing process.

In the embodiment of the present invention shown in FIGS. 4–7, classifier assembly 10 constructed in accordance with the present invention is operatively associated with center shaft 20 through an adjustable flange 36 mounted and driven (i.e., rotated in the direction illustrated by arrows in FIG. 5) by center shaft 20. Elongate arms 38 include a radially inner end portion 40 which is connected with flange 36, a radially outward extending portion 42 having protective guards 44 that face the direction of rotational motion, and a radially outer end portion 46 operatively associated with an annular sealing rotator member 48.

In this embodiment, outer end 46 extends circumferentially in a direction opposing the direction of rotational motion (in a generally "L-shaped" configuration) and includes a spacer member 50, which connects an axially outer surface 52 of outer end portion 46 with an axially inner portion 54 of rotator 48. The connection may be through any conventional means. Alternatively, outer end 46 may be in a generally T-shaped configuration.

An axially outer surface 56 of rotator 48 includes a radially inner, axially outward projecting ring 58. A radially outer ring is formed on the outer surface 56 of rotator 48 by projecting plates 60 (referred to herein as beaters 60) that protrude axially outward from rotator 48, and are either mounted to or integral with outer surface 56. Preferably, beaters 60 are substantially evenly spaced from one another along outer surface 56 of rotator 48, and the leading faces of beaters 60 (i.e., facing the direction of rotational motion) are fabricated of tungsten carbide tiles or coated with a wear resistant material for long wear life.

Classifier assembly 10 also includes an annular sealing stator member 62 which is secured to a stator support ring 64 that is mounted onto the radially inner ends of a cheek plate 66 that faces grinding section 16, a fan chamber side liner 68 and a housing plate 70. Housing plate 70 is disposed between cheek plate 66 and fan chamber side liner 68. Stator 62 is sloped radially outward as it extends axially outward into fan section 18. Stator 62 also includes an axially inner surface 72 having a stationary projecting ring 74 disposed thereon. Stationary projecting ring 74 protrudes axially inward from surface 72 into the circumferential channel formed between projecting ring 58 and beaters 60 on rotator 48.

Thus, during rotation of shaft 20, the motion of dynamic rotator 48 relative to motionless stator 62 of classifier assembly 10 forms a continuous clearance and labyrinth seal, which limits egress of unacceptably large sized particles, and in particular, limits radially outward egress of unacceptably large sized particles. Beaters 60, which are rotated along with rotator 48, impact coal particles passing between rotator 48 and stator 62 to provide further size reduction.

Acceptably sized coal particles passing through classifier assembly 10 enter fan section 18. Fan section 18 includes a fan wheel 76 with blades 78 mounted and driven by shaft 20. Preferably, blades 78 are formed of an abrasion-resistant alloy. The coal particles are typically transported from fan section 18 directly to the burners (not shown) through outlet 80.

Preferably, rotator 48 and stator 62 are fabricated of an abrasive resistant material and inner surface 72 of stator 62 and outer surface 56 of rotator 48 are coated with a wear resistant material, such as tungsten carbide or the like, capable of protecting these surfaces from abrasion. It is also preferable that there be no metal-to-metal contact of pulverizing elements or springs or wear-compensating devices to require shutdown for adjustment in pulverizer 12.

Although exemplary and preferred aspects and embodiments of the present invention have been described with a full set of features, it is to be understood that the disclosed system and method may be practiced successfully without the incorporation of each of those features. For example, many industries include applications that utilize raw materials that are first broken up into relatively small sized particles. Accordingly, the raw materials are fed into devices that employ one or more physical processes to reduce the size of the raw material prior to their use. A system and assembly constructed according to the present invention can be utilized for such purposes. It is further envisaged that the present invention can be employed in any rotary-type machinery where there is a need for restricting the egress of unacceptably sized particles. Thus, it is to be further understood that modifications and variations may be utilized without departure from the spirit and scope of this inventive system and method, as those skilled in the art will readily understand. Such modifications and variations are considered to be within the purview and scope of the appended claims and their equivalents.

What is claimed is:

1. A classifier assembly for mounting on a center shaft defining an axis of rotation and configured for rotational motion within a process chamber of a material size reducing system, the classifier assembly comprising:

(a) an elongate arm configured for mounting on the center shaft in such a manner as to extend radially outward from the center shaft; and (b) a labyrinthian sealing arrangement disposed circumferentially about the center shaft and operatively associated with a radially outer portion of the arm and configured for limiting the egress of particles from the process chamber based on particle size during rotational motion of the center shaft.

2. A classifier assembly as recited in claim 1, further comprising a plurality of elongate arms.

3. A classifier assembly as recited in claim 2, further comprising a flange for mounting the plurality of elongate arms to the center shaft.

4. A classifier assembly as recited in claim 1, wherein the labyrinthian sealing arrangement comprises:

(a) an annular rotator including an axially projecting, radially inner ring and a plurality of axially projecting members along a radially outer circumference of the rotator; and (b) an annular stator including an axially projecting portion, the axially projecting portion defining a radially inner surface and opposing radially outer surface, the stator being configured and dimensioned for mounting in the process chamber in such a manner as to be positioned axially adjacent to the rotator with the radially inner surface of the axially projecting portion in a radially adjacent relationship with respect to the radially inner ring of the rotator and the radially outer surface of the axially projecting portion in a radially adjacent relationship with respect to the plurality of axially projecting members along a radially outer circumference of the rotator.

5. A system for limiting particle egress in a material size reduction device having a chamber with a center shaft mounted for rotational motion therein, the system comprising:

(a) an elongate arm configured for mounting on the center shaft in such a manner as to extend radially outward from the center shaft; and (b) a labyrinthian sealing arrangement circumferentially disposed about the center shaft and operatively associated with a radially outer portion of the arm and configured for limiting the egress of particles from the chamber based on particle size during rotational motion of the center shaft.

6. A system as recited in claim 5, further comprising a plurality of elongate arms.

7. A system as recited in claim 6, further comprising a flange for mounting the plurality of elongate arms to the center shaft.

8. A system as recited in claim 5, wherein the labyrinthian sealing arrangement comprises:

(a) an annular rotator including an axially projecting, radially inner ring and a plurality of axially projecting members along a radially outer circumference of the rotator; and (b) an annular stator including an axially projecting portion, the axially projecting portion defining a radially inner surface and opposing radially outer surface, the stator being configured and dimensioned for mounting in the process chamber in such a manner as to be positioned axially adjacent to the rotator with the radially inner surface of the axially projecting portion in a radially adjacent relationship with respect to the radially inner ring of the rotator and the radially outer surface of the axially projecting portion in a radially adjacent relationship with respect to the plurality of axially projecting members along a radially outer circumference of the rotator.

9. A coal pulverizer having a grinding chamber and a center shaft defining an axis of rotation and configured for rotational motion within the grinding chamber, the coal pulverizer including a classifier assembly comprising:

(a) an elongate arm mounted on the center shaft in such a manner as to extend radially outward from the center shaft; and (b) an annularly shaped labyrinthian sealing arrangement operatively associated with a radially outer portion of the elongate arm and configured for limiting the egress of coal particles from the grinding chamber based on particle size during rotational motion of the center shaft.

10. A coal pulverizer as recited in claim 9, further comprising a plurality of elongate arms.

11. A coal pulverizer as recited in claim 10, further comprising a flange for mounting the plurality of elongate arms to the center shaft.

12. A coal pulverizer as recited in claim 9, wherein the labyrinthian sealing arrangement comprises:

(a) an annular rotator including an axially projecting, radially inner ring and a plurality of axially projecting members disposed along a radially outer circumference of the rotator; and (b) an annular stator including an axially projecting portion, the axially projecting portion defining a radially inner surface and opposing radially outer surface, the stator being configured and dimensioned for mounting in the process chamber in such a manner as to be positioned axially adjacent to the rotator with the radially inner surface of the axially projecting portion in a radially adjacent relationship with respect to the radially inner ring of the rotator and the radially outer surface of the axially projecting portion in a radially adjacent relationship with respect to the plurality of axially projecting members along a radially outer circumference of the rotator.

13. A coal pulverizer as recited in claim 12, wherein the axially projecting members disposed along a radially outer circumference of the rotator are substantially equally spaced along the radially outer circumference of the rotator.

14. A coal pulverizer as recited in claim 9, wherein crushed coal is supplied to the grinding chamber from a crusher chamber including a swing hammer assembly operatively associated with the center shaft for crushing coal.

15. A coal pulverizer as recited in claim 9, wherein the grinding chamber further includes a plurality of stationary pegs and an assembly having a plurality of grinding clips operatively associated with the center shaft and configured for grinding coal.

16. A coal pulverizer as recited in claim 9, wherein the egress of coal particles from the grinding chamber is received by a fan chamber including a fan assembly operatively associated with the center shaft and configured for transporting coal particles entrained with air.

17. A coal pulverizer as recited in claim 9, wherein the labyrinthian sealing arrangement limits the radially outward egress of unacceptably large sized coal particles from the grinding chamber.

* * * * *